US006109354A

United States Patent [19]

Ringgenberg et al.

[11] Patent Number: 6,109,354

[45] Date of Patent: Aug. 29, 2000

[54] CIRCULATING VALVE RESPONSIVE TO FLUID FLOW RATE THERETHROUGH AND ASSOCIATED METHODS OF SERVICING A WELL

[75] Inventors: Paul D. Ringgenberg, Carrollton; Neal G. Skinner, Lewisville, both of Tex.

[73] Assignee: Halliburton Energy Services, Inc., Dallas, Tex.

[21] Appl. No.: 09/265,905

[22] Filed: Mar. 10, 1999

Related U.S. Application Data

[62] Division of application No. 08/634,540, Apr. 18, 1996, abandoned.

[51] Int. Cl.[7] ..... E21B 34/10

[52] U.S. Cl. ..... 166/374; 166/319; 166/320; 166/321; 166/240; 166/386

[58] Field of Search ..... 166/319, 321, 166/323, 320, 240, 332.6, 334.4, 373, 374, 386

[56] References Cited

U.S. PATENT DOCUMENTS

| | | | |
|---|---|---|---|
| 4,113,012 | 9/1978 | Evans et al. | 166/264 |
| 4,355,685 | 10/1982 | Beck | 166/240 |
| 4,403,659 | 9/1983 | Upchurch | 166/374 |
| 4,527,629 | 7/1985 | Whiteley et al. | 166/321 |
| 4,650,001 | 3/1987 | Ringgenberg | 166/373 |
| 4,718,494 | 1/1988 | Meek | 166/373 |
| 5,355,959 | 10/1994 | Walter et al. | 166/321 |
| 5,609,178 | 3/1997 | Hennig et al. | 166/319 |
| 5,649,597 | 7/1997 | Ringgenberg | 166/373 |

*Primary Examiner*—Hoang Dang
*Attorney, Agent, or Firm*—William M. Imwalle; Marlin R. Smith

[57] ABSTRACT

A circulating valve and associated methods of servicing a well provide reliable operation, economical manufacture, and convenient maintenance in the circulating valve which is responsive to flow of fluid therethrough, and increased versatility in well servicing operations utilizing the valve. In a preferred embodiment, a circulating valve includes an upper case having a reverse circulating port formed radially therethrough, a circulating case having a circulating port formed radially therethrough, a lower adapter, a mandrel having a flow port formed radially therethrough, a biasing member, a ratchet, an inner sleeve, and a one-way flow restrictor carried on the mandrel. In an open configuration, fluid communication is permitted between the flow and circulating ports, and between the reverse circulating port and the flow restrictor. In a closed configuration, fluid communication is not permitted radially through the valve. A predetermined pressure differential across the mandrel is utilized to configure the valve in its open and closed configurations.

16 Claims, 7 Drawing Sheets

CIRCULATING VALVE RESPONSIVE TO FLUID FLOW RATE THERETHROUGH AND ASSOCIATED METHODS OF SERVICING A WELL

This is a division, of application Ser. No. 08/634,540, filed Apr. 18, 1996, now abandoned, such prior application being incorporated by reference herein in its entirety.

BACKGROUND OF THE INVENTION

The present invention relates generally to circulating valves utilized in subterranean wellbores and, in a preferred embodiment thereof, more particularly provides a circulating valve which is responsive to the rate of fluid flow therethrough and associated methods of servicing a well.

Subterranean wellbores are generally filled with fluids which extend from the wellbore's lower terminus substantially to the earth's surface. For safety reasons, a column of fluid is usually present adjacent each fluid-bearing formation intersected by the wellbore, so that the column of fluid may exert a hydrostatic pressure on each fluid-bearing formation sufficient to prevent uncontrolled flow of fluid from the formation to the wellbore, which uncontrolled flow of fluid could result in a blowout. This is particularly so in an uncased wellbore.

In order to transport fluid, tools, instruments, etc. longitudinally within the wellbore, it is common practice to utilize a string of tubular conduit, such as drill pipe or production tubing, to which tools and instruments may be attached, and within which fluid may be flowed and tools and instruments may be conveyed. When such drill pipe, production tubing, etc. (hereinafter referred to as "tubing") is disposed within the wellbore, the fluid column is effectively divided into at least two portions—one of which is contained in an annulus defined by the annular area separating the outside surface of the tubing from the inside surface of the wellbore, and the other of which is contained within the inside surface of the tubing. Thus, fluid, tools, instruments, etc. may be transported within the wellbore attached to or within the tubing without disturbing the relationship between the fluid column in the annulus and the fluid-bearing formations intersected by the wellbore. An example of such operations may be found in the Early Evaluation System of Halliburton Energy Services, which is described in a U.S. patent application Ser. No. 08/578,489 entitled EARLY EVALUATION SYSTEM WITH PUMP AND METHOD OF SERVICING A WELL filed Dec. 26, 1995, the disclosure of which is hereby incorporated by reference.

Circulating valves are well known in the art. The primary purpose of a circulating valve is to selectively permit fluid flow from the fluid column within the tubing to the fluid column in the annulus. Where, for example, it is desired to pump a treatment fluid from the earth's surface to a particular portion of the wellbore, such treatment fluid may be introduced into the tubing at the earth's surface, pumped longitudinally through the tubing, and radially outwardly ejected from the tubing through a circulating valve into the annulus at the desired location in the wellbore.

In the lexicon of those familiar with subterranean wellbore equipment and operations, valves which permit flow from the interior of the tubing to the annulus are commonly known as circulating valves, primarily because the operation of flowing fluid from the interior of the tubing to the annulus is termed "circulating". Where, however, fluids are flowed from the annulus to the interior of the tubing (i.e., in a direction radially opposite to that described immediately above), the operation is termed "reverse circulating". Valves which permit reverse circulating are, therefore, commonly known as reverse circulating valves or simply "reversing valves", although they are sometimes considered a subset of circulating valves, in which case the term "circulating valve" is meant to encompass both types of valves. Hereinafter, the term "circulating valve" will be used to refer to a valve which selectively permits either radially inwardly directed or radially outwardly directed flow to and/or from the interior of the tubing.

Circulating valves may be further subdivided by the manner in which they are initially opened or closed, and whether or not, and in what manner, they may be reopened or reclosed. An example of a pressure operated, initially closed, and recloseable reverse circulating valve may be found in the MIRV (Multi-ID Reversing Valve) marketed by Schlumberger Well Services and described in U.S. Pat. No. 4,403,659 to Upchurch. A similar valve is the MCCV (Multi-Cycle Circulating Valve) also marketed by Schlumberger Well Services. Note that each of the MIRV and MCCV may permit, when opened, circulating as well as reverse circulating flow therethrough.

The MIRV is typically initially closed when run into the wellbore in the tubing string. It is opened by applying a set number and level of predetermined pressure pulses to the interior of the tubing at the earth's surface. The pressure pulses cause rotation of a continuous J-slot mechanism which selectively permits an inner tubular mandrel to axially displace within an outer tubular housing. When the mandrel is permitted to axially displace within the housing, the required number and level of pressure pulses having been applied to the interior of the tubing, a number of openings formed radially through the housing are uncovered, allowing fluid flow therethrough. At that point, continuous reverse circulation is permitted, and circulation is also permitted as long as the rate of circulating flow is sufficiently low.

The MIRV is reclosed by circulating flow through the openings at a rate sufficient to cause a predetermined pressure differential radially across the housing. The openings formed through the housing are relatively small in flow area for this purpose. When the predetermined pressure differential is achieved, the mandrel is axially displaced, compressing a spring, and the J-slot mechanism rotates to permit the mandrel to again cover the openings in the housing when the pressure differential is released. At this point, the valve is returned to its initial closed configuration and may again be opened by applying the required number and level of pressure pulses to the interior of the tubing.

The MCCV is operated similar to the MIRV, but includes a complicated array of circulating and reversing ports, and flow restrictors associated with each set of ports, such that changes in direction of flow (i.e., from circulating to reverse circulating, or from reverse circulating to circulating) may cause axial displacement of the mandrel to rotate the J-slot mechanism and, thereby, determine the axial disposition of the mandrel relative to the ports in the housing.

In addition to the complicated configuration and operation of the MCCV, there are several disadvantages of the MIRV and MCCV designs. Pressure differentials across the housing are created by flowing fluid through relatively small flow area openings and ports, thus limiting the flow rate through the openings and ports, with no provision for relatively unrestricted flow radially through the housing. This means that, for example, reverse circulating through the valves at a relatively high flow rate requires a large pressure to be applied to the annulus. Where the wellbore is uncased, such large pressure applied to the annulus is undesirable as it will tend to force wellbore fluid radially outward into permeable formations intersected by the wellbore, possibly causing damage to the formations and necessitating expensive remedial treatment.

Another disadvantage of the MIRV is that the restricted flow area openings are formed on the outer housing. Such small diameter openings are easily plugged by debris present in the annulus, and this situation is further exacerbated where the wellbore is uncased. By comparison, the fluid in the interior of the tubing is usually much cleaner than the fluid in the annulus.

Yet another disadvantage is that the J-slot mechanism of the MIRV and MCCV is unnecessarily complex, requiring multiple circumferential J-slot members, a dog formed on the inner surface of the housing, and multiple pins installed radially through the housing to engage the J-slots. The alignment and installation of the J-slot mechanism is tedious, and the number of parts provides increased opportunity for failure or jamming of one or more of them. The J-slot mechanism is expensive to manufacture. Furthermore, no provision is made for lubricating the J-slot mechanism or preventing debris from interfering with its operation.

A further disadvantage of the MIRV is that its biasing member, a spirally wound compression spring, is continually exposed to the fluid present in the annulus. As discussed above with regard to the restricted flow area openings on the housing, the fluid in the annulus tends to include a relatively large amount of debris. Since the spring is continually exposed to the annular fluid, such debris may accumulate about the spring and affect its spring rate and/or prevent its proper operation.

A still further disadvantage of the MIRV is that the pins installed radially through the outer housing also provide a limit to the axial travel of the mandrel. This use of pins as travel stops, which pins are also used to rotate multiple J-slots, invites damage to the pins, and, therefore, invites malfunction of the J-slot mechanism.

Another disadvantage of the MIRV is that it requires rotation of the J-slot mechanism within the outer housing while maintaining circumferential alignment of the mandrel with the outer housing. For this purpose, the mandrel is provided with an axially extending slot which engages a radially inwardly extending dog formed on the interior surface of the outer housing. A bearing is provided for rotational support of the J-slot mechanism on the mandrel. Such bearing, slot and dog add to the complexity of the MIRV, and further add to the expense of its manufacture and maintenance.

The MIRV requires a multiplicity of polished seal bores and outer diameters due to the fact that at least two differential pressure areas are required for its operation. One differential pressure area is required to shift the mandrel downwardly when the circulation openings on the housing are closed. The other differential pressure area is required to shift the mandrel downwardly when the openings are open. These polished seal bores, outer diameters, and associated seals, seal grooves, etc. further add to the manufacturing cost, maintenance cost, and complexity of the MIRV.

From the foregoing, it can be seen that it would be quite desirable to provide a circulating valve which does not have a complicated configuration and operation, which does not require flowing fluid through relatively small openings to produce pressure differentials across its outer housing, which does not have small openings formed through its outer housing for circulation of fluid therethrough, which does not require multiple J-slot members, multiple pins, or dogs formed on the inner surface of the housing, which does not require bearings or rotation of the J-slot mechanism relative to the mandrel, which does not require circumferential alignment of the mandrel relative to the outer housing, which does not require the pins to also serve as mandrel travel stops, which does not continually expose the J-slot mechanism and biasing member to annular fluid, and which does not require an inordinate number of polished seal bores, diameters, seals, etc., but which is easily and economically manufactured and maintained, which provides relatively unrestricted flow radially through the outer housing, which is specially adapted for use in uncased wellbores, and particularly for use in the Halliburton Energy Services Early Evaluation System, which is capable of reliable operation utilizing a single J-slot and pin, and which provides for lubricated and debris-free operation of the J-slot mechanism. It is accordingly an object of the present invention to provide such a circulating valve and associated methods of servicing a well.

SUMMARY OF THE INVENTION

In carrying out the principles of the present invention, in accordance with an embodiment thereof, a circulating valve is provided which is responsive to the flow rate of fluid therethrough, and a corresponding method of servicing a well is also provided. In one disclosed embodiment, the circulating valve enables relatively unrestricted reverse circulating flow therethrough when the valve is open.

In broad terms, a circulating valve is provided for use within a subterranean well having an annulus and a tubular conduit longitudinally disposed therein, each of the annulus and tubular conduit having a fluid contained therein. The valve includes an outer housing, a mandrel, and, in one embodiment, a flow restricting member. A high rate of reverse circulating flow through the valve is permitted when the valve is open, but circulating flow therethrough is restricted when the valve is open.

The housing is generally tubular and has an upper attachment portion capable of sealingly engaging the tubular conduit, a first axially extending internal bore, and a second axially extending bore which is radially reduced relative to the first axially extending bore. A first radially extending opening is formed through the housing and intersects the first axially extending bore.

The mandrel is also generally tubular and is axially received in the housing. First and second outer side surfaces are formed on the mandrel, the first outer side surface being radially enlarged relative to the second outer side surface. The first outer side surface is in sealing and sliding engagement with the first axially extending bore, and the second outer side surface is in sealing and sliding engagement with the second axially extending bore. A second radially extending opening is formed through the mandrel and intersects the second outer side surface.

The mandrel has a first position relative to the outer housing in which the second opening is in fluid communication with the first opening. The mandrel further has a second position in which the second opening is disposed within the second axially extending bore and is isolated from fluid communication with the first opening.

The flow restricting member is radially inwardly disposed relative to a third opening formed radially through the housing. It is capable of permitting substantially unrestricted flow of the annulus fluid radially inwardly through the third opening. Flow of the tubing fluid radially outwardly through the third opening is, however, restricted by the member.

In one aspect of the present invention, fluid flow through the flow restrictor is not permitted when the mandrel is in its second position. Accordingly, a circulating valve is also provided which includes a case, a mandrel, and a flow restrictor carried on the mandrel.

The case is generally tubular and includes first, second, and third axially extending internal bores formed thereon. The second bore is axially intermediate the first and third bores. A first port is formed radially through the case and intersects the first bore. A second port is formed radially through the case and intersects the second bore.

The mandrel is generally tubular and is received axially within the case. The mandrel includes first, second, and third axially extending external diameter portions formed thereon which are slidingly and sealingly engaged with the first, second, and third bores, respectively. The second portion is axially intermediate the first and third portions. A third port is formed radially through the mandrel and intersects the first portion. A fourth port is formed radially through the mandrel and intersects the third portion.

The mandrel has first and second axial positions relative to the case. The first and third ports are in fluid communication when the mandrel is in the first axial position, and the second and fourth ports are in fluid communication when the mandrel is in the first axial position. The first and third ports are in fluid isolation when the mandrel is in the second axial position, and the second and fourth ports are in fluid isolation when the mandrel is in the second axial position.

The flow restrictor is carried on the mandrel adjacent the third port. It is capable of restricting radially outwardly directed fluid flow through the third port, and is also capable of permitting radially inwardly directed fluid flow through the third port.

In another aspect of the present invention, the circulating valve is relatively uncomplicated in design, due in large part to axial rotation of the mandrel being permitted relative to, and within, the outer housing. Consequently, apparatus for selectively permitting and preventing fluid flow radially therethrough is provided which includes tubular first, second, and third members, and a pin.

The first member includes a radially extending first opening formed therethrough, a first outer side surface, a first radially enlarged and axially extending inner side surface, and a second radially reduced and axially extending inner side surface. The first opening provides fluid communication between the first outer side surface and the first inner side surface.

The second member includes a radially extending second opening formed therethrough, a third inner side surface, a second radially enlarged outer side surface, and a third radially reduced outer side surface. The second opening provides fluid communication between the third inner side surface and the third outer side surface. The second member is axially and slidably disposed within the first member, and is axially rotatable within the first member.

The third member has fourth inner and fourth outer side surfaces. The fourth inner side surface is axially and rotatably disposed on the third outer side surface, and the fourth outer side surface has a continuous circumferential J-slot profile formed thereon.

The pin is installed radially through the first outer side surface, an end portion of the pin projecting radially inwardly from the first inner side surface. The end portion engages the J-slot profile and cooperates with the third member to axially rotate the third member relative to the first member when the second member is axially displaced relative to the first member.

In a further aspect of the present invention, a circulating valve is provided which produces axial displacement of the mandrel by fluid flow therethrough. The fluid flow through ports on the mandrel creates a differential pressure across the mandrel, which differential pressure acts to axially displace the mandrel. The circulating valve includes first and second generally tubular members, and a biasing member.

The first member includes first and second axially extending cylindrical outer side surfaces formed thereon, the first outer side surface being radially enlarged relative to the second outer side surface. First and second opposite ends, an internal axial flow passage extending from the first opposite end to the second opposite end, and a flow port formed radially therethrough are also included on the first member. The flow port has a first flow area and permits fluid communication between the axial flow passage and the second outer side surface.

The second member is axially disposed relative to the first member and radially outwardly overlaps the first member. The second member includes first and second axially extending cylindrical inner side surfaces formed thereon, the first inner side surface being radially enlarged relative to the second inner side surface. The first outer side surface is slidably and sealingly received in the first inner side surface, and the second outer side surface is slidably and sealingly received in the second inner side surface. The first inner side surface is radially spaced apart from the second outer side surface and an annular space is defined therebetween.

The biasing member is disposed within the second member. It exerts a first biasing force against the first member first opposite end to thereby bias the first member in a first axial direction relative to the second member.

The first member is capable of having a second biasing force applied thereto in a second axial direction opposite to the first axial direction when a fluid is flowed from the axial flow passage to the annular space through the flow port. The first member is axially displaced in the second direction relative to the second member when the second biasing force exceeds the first biasing force.

In yet another aspect of the present invention, a circulating valve for use within a subterranean wellbore is provided which has a ratchet isolated from the annulus fluid and contained in a chamber substantially filled with a debris-free fluid. The valve includes a housing, a mandrel, a ratchet member, a pin, and an annular piston.

The housing is tubular and includes a radially extending first opening formed therethrough, a first outer side surface, a first radially enlarged and axially extending inner side surface, and a second radially reduced and axially extending inner side surface. The first opening provides fluid communication between the outer side surface and the first inner side surface.

The mandrel is tubular and includes a radially extending second opening formed therethrough, a third inner side surface, a second radially enlarged outer side surface, and a third radially reduced outer side surface. The second opening provides fluid communication between the third inner side surface and the third outer side surface. The mandrel is axially slidably disposed within the housing.

The ratchet member is also tubular and includes fourth inner and fourth outer side surfaces. The fourth inner side surface is axially and rotatably disposed on the third outer side surface. The fourth outer side surface has a continuous circumferential J-slot profile formed thereon.

The pin is installed radially through the first outer side surface with an end portion of the pin projecting radially inwardly from the first inner side surface. The end portion engages the J-slot profile and cooperates with the ratchet member to axially rotate the ratchet member relative to the housing when the mandrel is axially displaced relative to the housing.

The annular piston slidably and sealingly engages the housing first inner side surface and the mandrel third outer side surface. The annular piston isolates the ratchet member from fluid communication with the first opening.

In still another aspect of the present invention, a circulating valve is provided which includes a biasing member that is at least partially isolated from contact with the annulus fluid. Accordingly, a circulating valve is provided which includes a mandrel, a case, a biasing member, and an inner sleeve.

The mandrel is generally tubular and has first and second axially extending cylindrical outer side surfaces formed thereon. The first outer side surface is radially enlarged relative to the second outer side surface. The mandrel also includes first and second opposite ends, an internal axial flow passage extending from the first opposite end to the second opposite end, and a flow port formed through the first member. The flow port permits fluid communication between the axial flow passage and the second outer side surface, and has a first flow area.

The case is generally tubular, is axially disposed relative to the mandrel, and radially outwardly overlaps the mandrel. The case includes first and second axially extending cylindrical inner side surfaces formed thereon. The first inner surface is radially enlarged relative to the second inner side surface. The first outer side surface is slidably and sealingly received in the first inner side surface, and the second outer side surface is slidably and sealingly received in the second inner side surface. The first inner side surface is radially spaced apart from the second outer side surface and defines an annular space therebetween.

The biasing member is disposed within the case and exerts a biasing force against the mandrel first opposite end to thereby bias the mandrel in a first axial direction relative to the case. The inner sleeve is generally tubular and is slidably disposed within the biasing member. The inner sleeve has a radially enlarged end portion disposed axially intermediate the mandrel first opposite end and the biasing member, and a series of axially spaced apart openings formed radially therethrough. The openings permitting fluid communication between the biasing member and the axial flow passage.

Apparatus for use in a subterranean well to control flow of fluid therein is also provided. The apparatus has an inner sleeve which limits axial travel of a mandrel. The apparatus includes first and second tubular structures, first and second circumferential seals, an inner sleeve, and a spring.

The first tubular structure has first, second, third, fourth, and fifth successive axially extending bores formed thereon. The second bore is radially enlarged relative to the first and third bores, and the fourth bore is radially enlarged relative to the fifth bore. The first structure also includes an outer side surface, a radially extending first shoulder defined by the first bore and the second bore, a radially extending second shoulder defined by the fourth bore and the fifth bore, and a circulating port having a first flow area. The circulating port permits fluid communication between the second bore and the outer side surface.

The second tubular structure is axially slidably received in the first tubular structure and has an axially extending flow passage formed therethrough, first and second outer side surfaces, first and second opposite ends, and a flow port having a second flow area less than the first flow area. The first outer side surface is radially enlarged relative to the second outer side surface and is received within the second bore. The second outer side surface is received in the third bore. The flow port permits fluid communication between the second outer side surface and the flow passage.

The first circumferential seal sealingly engages the second outer side surface and the third bore. The second circumferential seal sealingly engages the first outer side surface and the second bore.

The inner sleeve is axially slidably disposed within the first tubular structure and has first and second opposite ends. The sleeve first opposite end contacts the second tubular structure second opposite end, and the sleeve second opposite end is received in the fourth bore.

The spring is axially extending and is disposed radially intermediate the sleeve and the first tubular structure. The spring applies a first biasing force to the sleeve and the second tubular structure in a first axial direction.

The second tubular structure has a first axial position in which the spring biases the second tubular structure first opposite end to contact the first shoulder and the flow port is axially intermediate the first and second circumferential seals. The second tubular structure also has a second axial position in which the sleeve second opposite end contacts the second shoulder and the first circumferential seal is axially intermediate the flow port and the second circumferential seal.

In yet another aspect of the present invention, a circulating valve is provided in which the same differential area is used to displace a mandrel when the valve is open as when the valve is closed. Accordingly, apparatus operatively positionable within a subterranean well, the well having a tubular conduit disposed therein defining an annulus radially intermediate the conduit and a bore of the well, and the well further having fluid in the conduit at a first pressure and fluid in the annulus at a second pressure, is provided. The apparatus includes a housing and a mandrel.

The housing is tubular and is sealingly attachable to the conduit and suspendable therefrom. The housing includes a circulating port formed radially therethrough, the circulating port being capable of permitting fluid communication between the fluid in the conduit and the fluid in the annulus. A first axially extending bore intersects and is in fluid communication with the circulating port. A second axially extending bore is axially spaced apart from the circulating port.

The mandrel is also tubular and is received in the housing. The mandrel includes an axially extending flow passage formed therethrough, a first outer diameter sealingly and slidably engaging the first bore, a second outer diameter sealingly and slidably engaging the second bore, and a flow port extending radially through the mandrel from the flow passage to the second outer diameter. The mandrel has a first axial position relative to the housing in which the flow port is axially intermediate the first outer diameter and the second bore, and further in which the flow port is in fluid communication with the circulating port. The mandrel also has a second axial position relative to the housing in which the flow port is isolated from fluid communication with the circulating port by the sealing engagement between the second bore and the second outer diameter.

The first and second diameters define a differential area therebetween. The mandrel is axially displaced relative to the housing from the first axial position when the conduit fluid pressure exceeds the annulus fluid pressure by a first predetermined differential pressure. The first predetermined differential pressure is determined at least partially by the differential area. The mandrel is also axially displaced relative to the housing from the second axial position when the conduit fluid pressure exceeds the annulus fluid pressure by a second predetermined differential pressure, the second predetermined differential pressure being determined at least partially by the differential area.

A method of servicing a subterranean well having a borehole intersecting a fluid bearing formation is also provided. The method includes the steps of: (1) providing a circulating valve having an axial flow passage formed therethrough, a generally tubular outer housing, the housing having a circulating port formed radially through a sidewall portion thereof, a generally tubular mandrel, the mandrel having a flow port formed radially therethrough, and a generally tubular ratchet, the ratchet having a J-slot formed thereon, and the circulating valve having an open configuration wherein the flow port is in fluid communication with the circulating port, an intermediate configuration wherein the flow port is isolated from fluid communication with the circulating port, and a closed configuration wherein the flow port is isolated from fluid communication with the circulating port, the valve having a selected one of the configurations depending on an orientation of the ratchet relative to the housing and a predetermined differential pressure across the mandrel; (2) installing the valve on a tool string having an inner axial bore, such that the valve flow passage is in fluid communication with the tool string bore; (3) installing a formation pump on the tool string, such that the valve is axially intermediate the pump and the tool string; (4) running the valve, the pump, and the tool string into the well, thereby defining an annulus radially intermediate the tool string and the well bore; and (5) configuring the valve in the open configuration.

Another method of servicing a subterranean well having a bore intersecting a fluid bearing formation is provided as well. The method includes the steps of: (1) providing a circulating valve having an axial flow passage formed therethrough, a generally tubular outer housing, the housing having first and second axially spaced apart circulating ports formed radially therethrough, a generally tubular mandrel, the mandrel having a flow port formed radially therethrough and an opening formed radially therethrough axially spaced apart from the flow port, a shuttle carried on the mandrel, the shuttle being biased to restrict radially outwardly directed flow through the opening, and a generally tubular ratchet, the ratchet having a J-slot formed thereon, and the circulating valve having an open configuration wherein the flow port is in fluid communication with the first circulating port and the opening is in fluid communication with the second circulating port, an intermediate configuration wherein the flow port is isolated from fluid communication with the first circulating port and the opening is isolated from fluid communication with the second circulating port, and a closed configuration wherein the flow port is isolated from fluid communication with the first circulating port and the opening is isolated from fluid communication with the second circulating port, the valve having a selected one of the configurations depending on an orientation of the ratchet relative to the housing and a predetermined differential pressure across the mandrel; (2) installing the valve on a tool string having an inner axial bore, such that the valve flow passage is in fluid communication with the tool string bore; (3) installing a formation pump on the tool string, such that the valve is axially intermediate the pump and the tool string; (4) running the valve, the pump, and the tool string into the well, thereby defining an annulus radially intermediate the tool string and the well bore; and (5) configuring the valve in the open configuration.

The use of the disclosed circulating valve and associated methods of servicing a well provides a large number of benefits, including ease of assembly, operation, and maintenance, economical manufacture and maintenance, simplified construction resulting in enhanced reliability, and reduced susceptibility to debris, which also results in enhanced reliability.

DETAILED DESCRIPTION

Figure 1A:
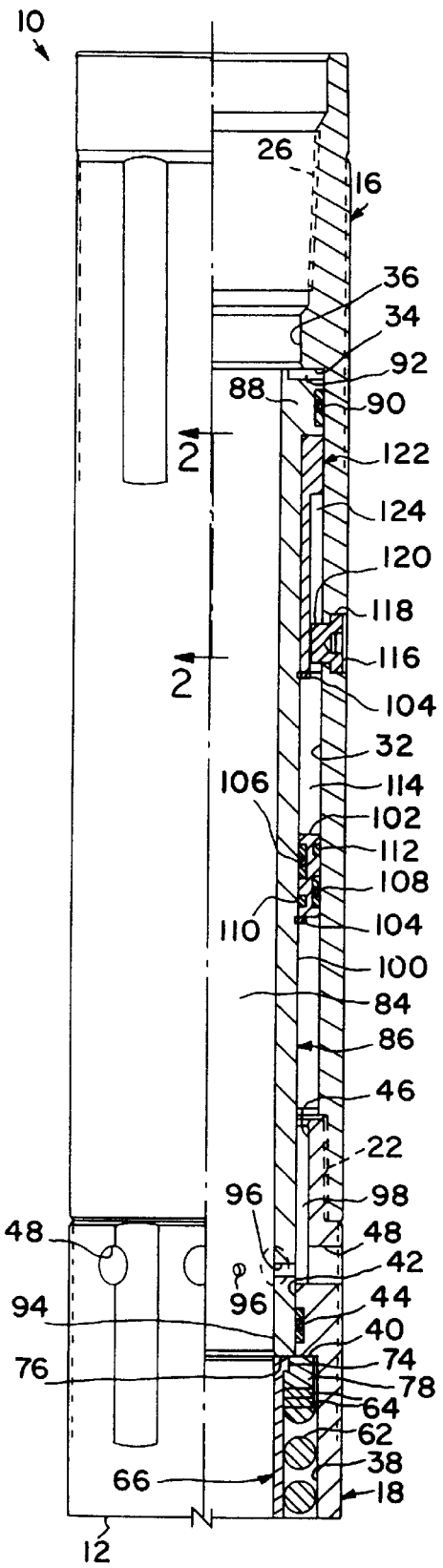
FIGS. 1A–1B are quarter-sectional views of successive axial portions of a first circulating valve embodying principles of the present invention, the circulating valve being shown in an open configuration thereof.
Figure 1B:
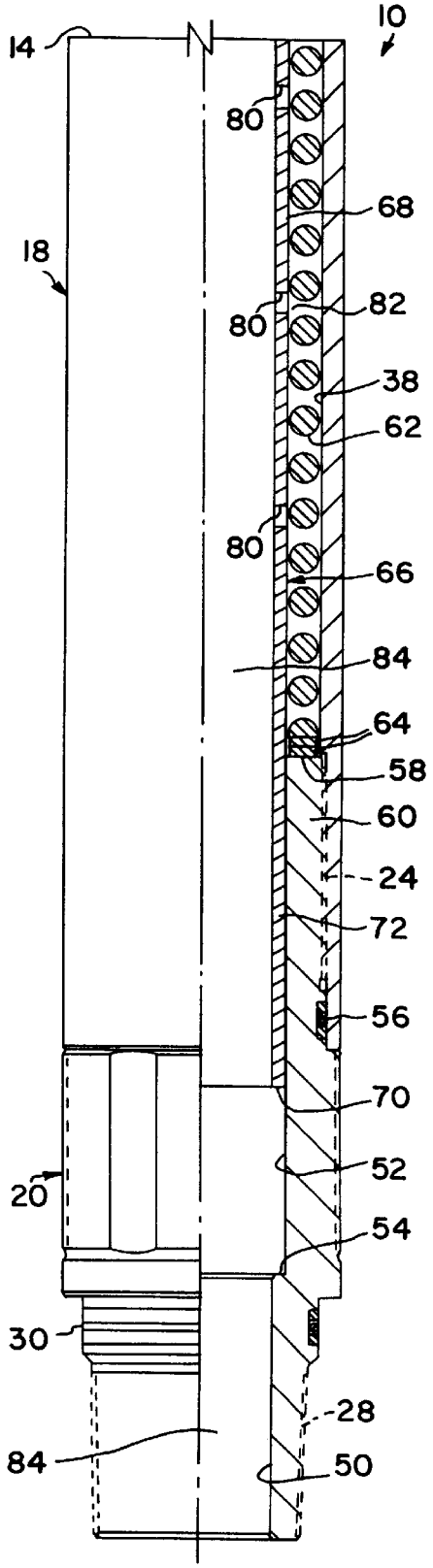

Illustrated in FIGS. 1A–1B is a circulating valve 10 which embodies principles of the present invention. The valve 10 is shown in a configuration in which the valve is run into a subterranean well. In the following detailed description of the embodiments of the present invention representatively illustrated in the accompanying figures, directional terms, such as "upper", "lower", "upward", "downward", etc., are used in relation to the illustrated valve 10 as it is depicted in the accompanying figures. It is to be understood that the valve 10 may be utilized in vertical, horizontal, inverted, or inclined orientations without deviating from the principles of the present invention. For convenience of illustration, FIGS. 1A–1B show the valve 10 in successive axial portions, but it is to be understood that the valve is a continuous assembly, lower end 12 of FIG. 1A being continuous with upper end 14 of FIG. 1B.

Valve 10 includes an upper case 16, a circulating case 18, and a lower adapter 20. Each of these are generally tubular shaped and are axially joined by means of threaded connections 22 and 24. The circulating case 18 is thus disposed axially intermediate the upper case 16 and the lower adapter 20.

The upper case 16 has an axially extending threaded portion 26 internally formed thereon for threaded and sealing attachment to tubing, another tool, equipment, etc. (not shown). In a preferred manner of using the valve 10, the upper case 16 is threadedly and sealingly attached to tubing at threaded portion 26, suspended therefrom, and inserted into a wellbore. It is to be understood, however, that valve 10 may be otherwise interconnected with tubing, tools, equipment, etc. without departing from the principles of the present invention.

Figure 6:
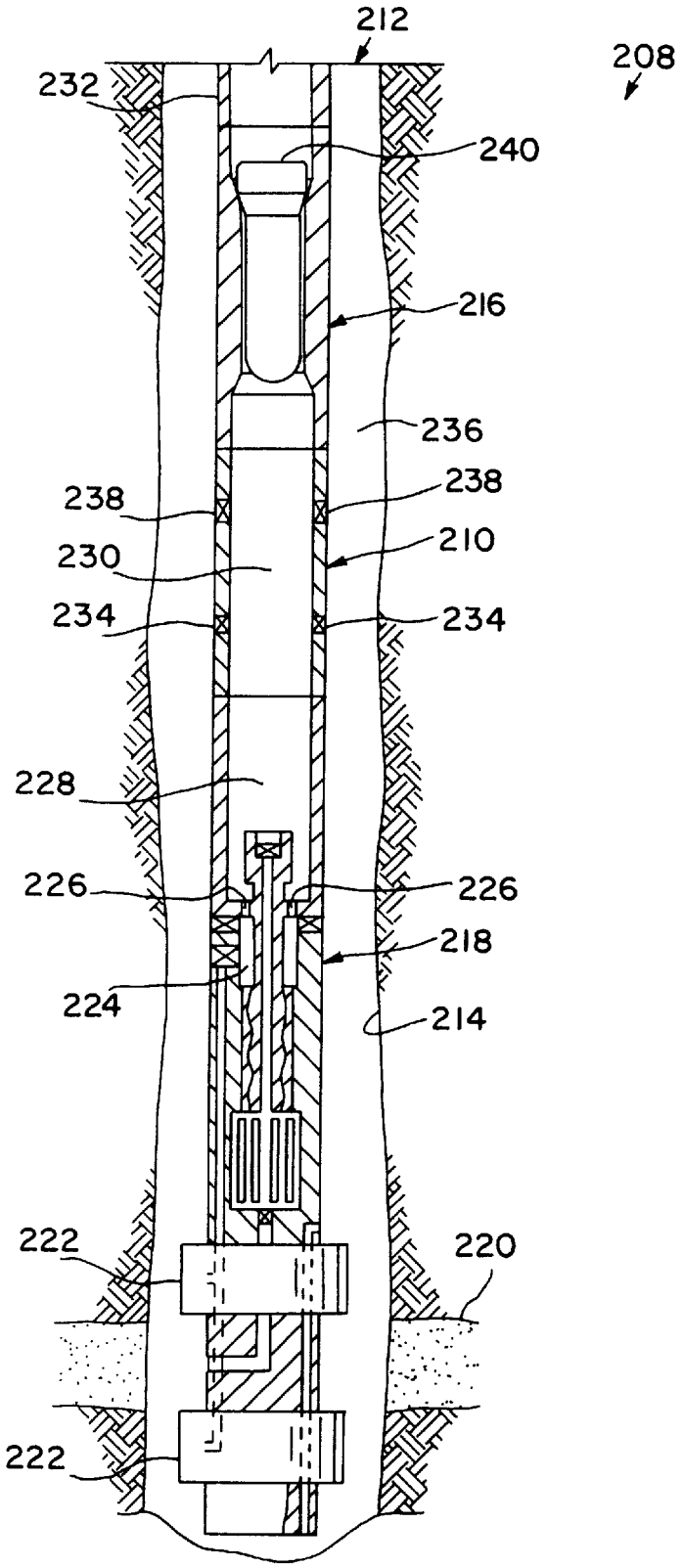
FIG. 6 is a cross-sectional view of a subterranean well showing a method of servicing the well, which method embodies principles of the present invention.

The lower adapter 20 has an axially extending threaded portion 28 externally formed thereon and an external circumferential seal 30 disposed thereon for threaded and sealing attachment to tubing, another tool, equipment, etc. (not shown). In a preferred manner of using the valve 10, the lower adapter 20 is threadedly and sealingly attached to other equipment, which is suspended therefrom in a wellbore. A preferred manner of using the valve 10 is shown in FIG. 6, wherein it may be seen that the valve 10, which may be utilized for the valve indicated by reference numeral 210, may be disposed axially intermediate other items of equipment, which are longitudinally disposed within a wellbore. It is to be understood that the valve 10, in other methods of servicing a well, may be conveyed into the well attached to coiled tubing, or any other means of transporting the valve within the well, without departing from the principles of the present invention.

Upper case 16 has an axially extending seal bore 32 internally formed thereon axially downwardly disposed relative to the threaded portion 26. A radially inwardly extending shoulder 34 is defined by the seal bore 32 and another axially extending internal bore 36 formed axially intermediate the threaded portion 26 and the seal bore 32.

Circulating case 18 has an axially extending bore 38 internally formed thereon, which is axially upwardly disposed relative to the threaded connection 24. A radially inwardly extending shoulder 40 is defined by the bore 38 and another axially extending internal bore 42 formed on the circulating case 18, which is axially upwardly disposed relative to the bore 38. Bore 42 has an internal circumferential seal 44 disposed thereon, the purpose of which will be more fully described hereinbelow.

Axially upwardly disposed relative to the bore 42 is another axially extending bore 46 internally formed on the circulating case 18. The bore 46 is radially outwardly enlarged relative to the bore 42 and partially radially inwardly underlies the threaded connection 22. A series of eight radially extending and circumferentially spaced apart circulating ports 48 are formed through the circulating case 18, the ports intersecting the bore 46 and being axially upwardly disposed relative to the bore 42.

The lower adapter 20 has an axially extending bore 50 internally formed thereon. Another axially extending bore 52 is internally formed on the lower adapter 20 axially upwardly disposed relative to the bore 50. The bore 52 is radially enlarged relative to the bore 50, and a radially inwardly extending shoulder 54 is defined therebetween. An external circumferential seal 56 is disposed on the lower adapter 20 and sealingly engages the circulating case 18 adjacent the threaded connection 24. A radially extending and axially upwardly facing shoulder 58 is formed on an upper end portion 60 of the lower adapter 20.

A biasing member, such as axially extending compression spring 62, is disposed within the circulating housing 18 radially inward of the bore 38. The spring 62 is axially intermediate the shoulders 40 and 58, and is separated therefrom by annular spacers or bearings 64, two each of the spacers being disposed axially intermediate the spring and each of the shoulders 40 and 58.

A generally tubular and axially extending sleeve 66 is radially inwardly disposed relative to the spring 62. An outer side surface 68 of the sleeve 66 is axially received within the spring 62 and extends axially downwardly into the bore 52 of the lower adapter 20. A radially extending and downwardly facing shoulder 70 is formed on a lower end portion 72 of the sleeve 66, and the lower end portion is received within the bore 52 of the lower adapter 20. A radially outwardly enlarged upper end portion 74 of the sleeve 66 has a radially extending upwardly facing shoulder 76 formed thereon. The sleeve 66 is axially upwardly supported by an annular retainer 78, which engages the upper end portion 74 of the sleeve axially intermediate the upper end portion and the spacers 64.

A series of radially extending and axially spaced apart openings 80 are formed through the sleeve 66 axially intermediate the upper end portion 74 and the lower end portion 72, such that an axially extending annular cavity 82 radially intermediate the sleeve outer side surface 68 and the circulating case bore 38, within which the spring 62 is axially disposed, is in fluid communication with an inner axial flow passage 84 extending through the valve 10. As will be more fully described hereinbelow, sleeve 66 may be axially downwardly displaced within the circulating case 18 and the lower adapter 20, which axially downward displacement compresses spring 62 and axially compresses annular cavity 82. A benefit derived from the disposition of openings 80 relative to the cavity 82 as hereinabove described is that any debris which may have accumulated in the cavity will be flushed therefrom when the cavity is compressed and the openings 80 are axially downwardly displaced relative thereto.

A generally tubular and axially extending mandrel 86 is radially inwardly received within the upper case 16 and extends axially downwardly into the circulating case 18. The mandrel 86 has a radially enlarged upper end portion 88 formed thereon and an external circumferential seal 90 disposed on the upper end portion. The seal 90 sealingly engages the bore 32 formed on the upper case 16.

A series of radially extending and circumferentially spaced apart scallops 92 (only one of which is visible in FIG. 1A) are formed on the upper end portion 88 to ensure that pressure in flow passage 84 is transmitted between the shoulder 34 and the upper end portion 88. The axially upward displacement of the mandrel 86 is thus limited by axial contact between the upper end portion 88 and the shoulder 34. A lower end portion 94 of the mandrel 86 contacts the shoulder 76 formed on the sleeve 66, thus limiting the mandrel's 86 axially downward displacement by the contact therebetween.

A series of eight radially extending and circumferentially spaced apart flow ports 96 are formed through the mandrel 86 adjacent the lower end portion 94. With the valve 10 in its open configuration as representatively illustrated in FIGS. 1A–1B, the flow ports 96 are substantially axially aligned with circulation ports 48 formed through the circulating case 18.

As shown in FIG. 1A, the ports 96 and 48 are also radially aligned, but it is to be understood that such radial alignment is not necessary for proper operation of the valve 10, since fluid communication between the ports 96 and 48 is provided by an axially extending annular cavity 98 formed radially intermediate bore 46 of the circulating case 18 and an outer side surface 100 of the mandrel 86. With the valve 10 in its representatively illustrated open configuration, the annular cavity 98 is also radially intermediate the ports 96 and 48, and, thus, the radial alignment therebetween is unnecessary.

As will be described more fully hereinbelow, the mandrel 86 may be axially downwardly displaced. Such axial displacement of the mandrel 86 causes corresponding axially downward displacement of the sleeve 66, thereby compressing the spring 62 as described hereinabove. Note that when mandrel 86 is axially downwardly displaced, ports 96 will axially traverse the seal 44 on the circulating case 18. Seal 44 sealingly engages the outer side surface 100 of the mandrel 86, and continues to sealingly engage the outer side surface 100 after the ports 96 have axially traversed the seal 44. Note, also, that after the ports 96 have axially downwardly traversed the seal 44, inner flow passage 84 is in fluid isolation from the annular cavity 98, circulation ports 48, and the exterior of the valve 10 via the ports 48.

A generally tubular and axially extending floating piston 102 is disposed radially intermediate the outer side surface 100 of the mandrel 86 and the bore 32 of the upper case 16. Axial displacement of the floating piston 102 is limited by axially spaced apart retaining rings 104 disposed in grooves formed on the outer side surface 100. Piston 102 has internal and external circumferential seals 106 and 108, respectively, disposed thereon which sealingly engage the outer side surface 100 and the bore 32, respectively. Internal and external glide rings 110 and 112, respectively, aid in providing smooth sliding engagement of the piston 102 with the outer side surface 100 and the bore 32.

An axially extending annular cavity 114 is defined axially intermediate the upper end portion 88 of the mandrel 86 and the piston 102, and radially intermediate the outer side surface 100 and the bore 32. In a preferred embodiment of the present invention, the annular cavity 114 is substantially filled with a fluid, such as a lubricating oil or a silicone-based fluid. Applicants prefer use of a silicone-based fluid in annular cavity 114 rather than a hydrocarbon-based fluid due to the potential dangers inherent in subjecting hydrocarbons to the elevated temperatures and pressures usually present in a subterranean well, but it is to be understood that any of a wide variety of fluids may be utilized in annular cavity 114 without departing from the principles of the present invention.

Two externally threaded lugs 116, only one of which is visible in FIG. 1A, are installed radially through threaded openings 118 formed radially through the upper case 16, and sealingly engage the upper case. Preferably, such sealing engagement is provided by a seal, such as an o-ring, disposed between each of the lugs 116 and the upper case 16. The fluid described hereinabove may be introduced to the annular cavity 114 through one of the openings 118 before the last one of the lugs 116 is thus installed. Each lug 116 has a radially inwardly extending pin end 120 formed thereon, the purpose of which will be more fully described hereinbelow.

A generally tubular and axially extending ratchet 122 is axially disposed within the annular cavity 114. The ratchet 122 is axially retained intermediate the mandrel upper end portion 88 and an upper one of the retaining rings 104. Note that the ratchet 122 is not circumferentially retained in any manner relative to the mandrel 86 and is, thus, permitted to rotate on the outer side surface 100 of the mandrel.

The ratchet 122 has a radially inwardly extending slotted profile continuously and circumferentially projected thereon, of the type commonly referred to as a J-slot 124. The pin end 120 of each lug 116 radially inwardly engages the J-slot 124, and such engagement therebetween restricts circumferential rotation of the ratchet 122 relative to the upper case 16, or, in other words, engagement therebetween induces a particular circumferential rotation of the ratchet 122 relative to the upper case 16, which particular circumferential rotation is determined by the J-slot, in a manner which will be more fully described hereinbelow. It is to be understood that fewer or greater numbers of lugs 116 may be provided without departing from the principles of the present invention.

It will be readily apparent to one of ordinary skill in the art that the ratchet 122 could be otherwise implemented in the present invention. For example, the J-slot 124 could be internally formed and the pin ends 120 could extend outwardly from the outer side surface 100 of the mandrel 86. The J-slot 124 could be discontinuous, instead of continuous. The J-slot 124 could extend axially, instead of circumferentially, about the ratchet 122. The pin ends 120 could be integrally formed on bore 32. The pin ends 120 could be separate spherical members, instead of cylindrical projections formed on the lugs 116. The ratchet 122 could be integrally formed with the mandrel 86 or upper case 16. These and other modifications may be utilized without departing from the principles of the present invention.

With the valve 10 in its open configuration as representatively illustrated in FIGS. 1A–1B, fluid may be circulated axially through the inner flow passage 84, radially outwardly through the flow ports 96, into annular chamber 98, and radially outwardly through circulation ports 48. Fluid may also be reverse circulated through the valve 10, the fluid entering the circulation ports 48, flowing radially inwardly into the annular chamber 98, radially through the flow ports 96, and thence into the inner flow passage 84.

In the valve 10 as representatively represented in FIGS. 1A–1B, flow ports 96 are somewhat smaller in flow area than circulation ports 48. When it is desired to axially downwardly displace the mandrel 86 against the upwardly biasing force of the spring 62, circulating flow of fluid radially outward through the flow ports 96 may be increased to cause a sufficient differential pressure between the inner flow passage 84 and the annular cavity 98 to act on the differential area defined by the sealing engagement of the seal 90 with the bore 32 and sealing engagement of the seal 44 with the outer side surface 100. Such differential pressure acting on such differential area produces an axially downwardly directed force which may exceed the upwardly biasing force of the spring 62 and, thereby, forces the mandrel 86 to displace axially downward.

In a preferred embodiment, applicants have balanced such upwardly biasing force of the spring 62 with such differential area radially intermediate the bore 32 and outer side surface 100, so that a differential pressure of 120 pounds per square inch acting from the inner flow passage 84 to the annular cavity 98 is required to axially downwardly displace the mandrel 86. It is to be understood, however, that other differential areas and other upwardly biasing forces may be utilized to require other differential pressures to displace the mandrel 86 without departing from the principles of the present invention.

Note that, when mandrel 86 is axially downwardly displaced sufficiently far that flow ports 96 axially traverse the seal 44, fluid flow through the flow ports is no longer required to produce a differential pressure from the flow passage 84 to the annular cavity 98, as the flow passage is then isolated from the annular cavity 98. Thus, an indication is given to an operator of the valve 10 that the mandrel 86 has been axially downwardly shifted by the absence of flow from the flow passage 84 to the exterior of the valve. Where the valve 10 is installed on tubing in a fluid filled subterranean well, such absence of flow may be readily recognizable by an increase in pressure applied to the interior of the tubing, and a lack of fluid returned to the annulus.

Figure 2A:
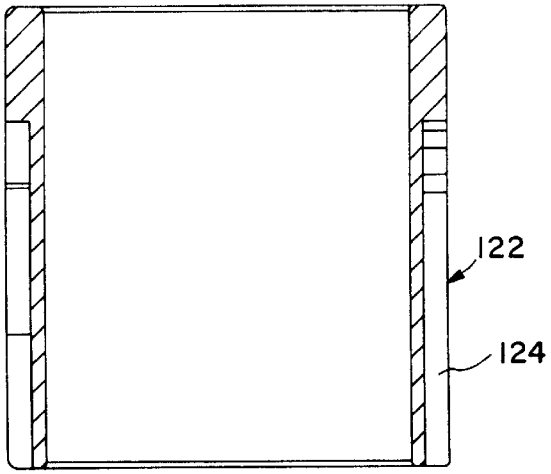
FIG. 2A is an enlarged scale cross-sectional view through a ratchet portion of the first circulating valve, taken along line 2—2 of FIG. 1A.
Figure 2B:
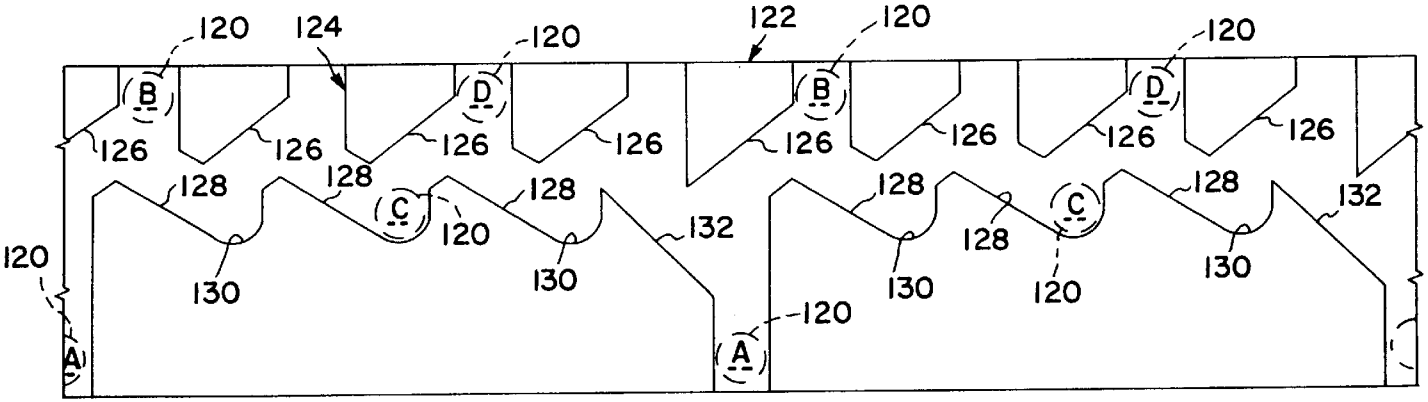
FIG. 2B is an enlarged scale view of an outer side surface of the ratchet of FIG. 2A, the longitudinal projection of the outer side surface as shown in FIG. 2B corresponding to the circumferential projection of the outer side surface as shown in FIG. 2A.

Referring additionally now to FIGS. 2A–2B, the ratchet 122 is representatively illustrated. FIG. 2A is rotated ninety degrees about its axis from that indicated by line 2—2 of FIG. 1A for illustrative clarity. It may now be clearly seen that J-slot 124 completely circumscribes the ratchet 122 and forms a continuous path for the pin ends 120 of the lugs 116 circumferentially about the ratchet. Dashed outlines of representatively positioned pin ends 120 have been illustratively provided in FIG. 2B, but it is to be understood that the pin ends 120 may be otherwise positioned without departing from the principles of the present invention.

With the valve 10 in its open configuration as representatively illustrated in FIGS. 1A–1B, the pin ends 120 are disposed in the J-slot 124 at positions A. Note that the J-slot 124 is axially downwardly open relative to the positions A, such that axially downward displacement of the pin ends 120 relative to the ratchet 122 is not restricted by the J-slot. As described hereinabove, axially upward displacement of the mandrel 86, and, thus, of the ratchet 122 which is carried thereon, is limited by the contact between the mandrel and the upper case 16. Therefore, damage to the pin ends 120 is prevented by providing other means of limiting relative axial displacement between the ratchet 122 and the pin ends.

When the mandrel 86 is axially downwardly displaced relative to the upper case 16, pin ends 120 displace upwardly relative to the ratchet 122, and eventually contact circumferentially inclined surfaces 126, thereby inducing axially rotational displacement of the ratchet 122 relative to the pin ends 120. As described hereinabove, the ratchet 122 may axially rotate on the outer side surface 100 of the mandrel 86, but is not required to so rotate since the ratchet 122 and mandrel 86 are permitted to axially rotate together. Further axially downward displacement of the mandrel 86 relative to the upper case 16 will cause the pin ends 120 to upwardly displace relative to the ratchet 122 until the pin ends are at positions B.

Figure 3A:
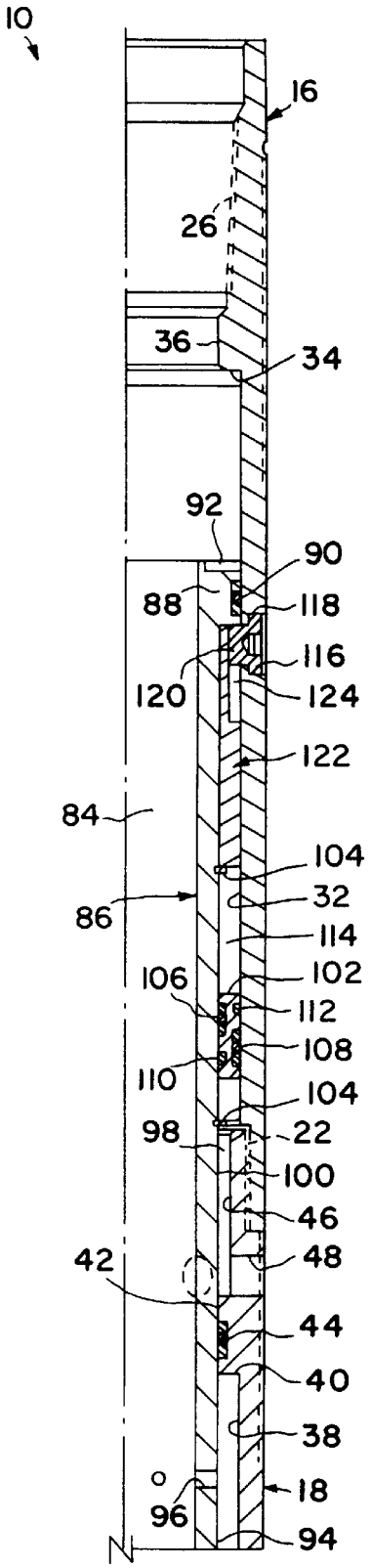
FIGS. 3A–3B are quarter-sectional views of successive axial portions of the first circulating valve, the valve being shown in an intermediate configuration thereof.
Figure 3B:
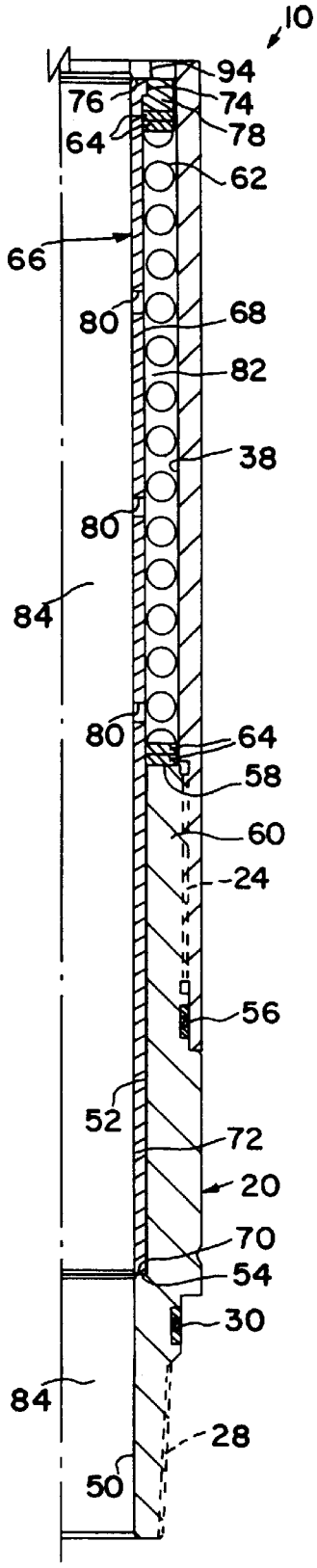

Referring additionally now to FIGS. 3A–3B, the valve 10 is representatively illustrated in an intermediate configuration thereof, wherein the mandrel 86 has been completely axially downwardly displaced relative to the upper case 16. Further axially downward displacement of the mandrel 86 is prevented by contact between the shoulder 70 on the lower end portion 72 of the sleeve 66 and the shoulder 54 on the lower adapter 20.

Such contact between the shoulders 54 and 70 to thus limit the axially downward displacement of the mandrel 86 prevents the possibility of damage to the pin ends 120 that would be present if the pin ends were utilized to limit the axially downward displacement of the mandrel. Note that the J-slot 124 is axially upwardly open relative to the positions B, such that axially upward displacement of the pin ends 120 relative to the ratchet 122 is not restricted by the J-slot.

With the valve 10 in its intermediate configuration as representatively illustrated in FIGS. 3A–3B, the inner flow passage 84 is isolated from the annular chamber 98 and radially outward flow from the flow ports 96 to the circulation ports 48 is not permitted. Note that the spring 62 has been axially compressed, such that when the above-described differential pressure is removed, which differential pressure caused the mandrel 86 to axially downwardly displace, the mandrel will be thereby axially upwardly biased.

Figure 4A:
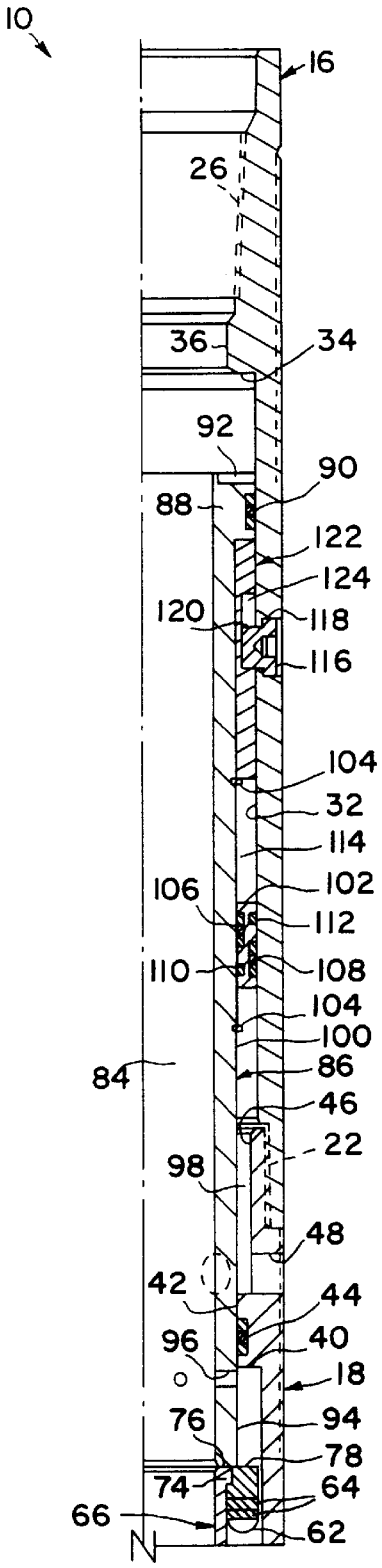
FIGS. 4A–4B are quarter-sectional views of successive axial portions of the first circulating valve, the valve being shown in a closed configuration thereof.
Figure 4B:
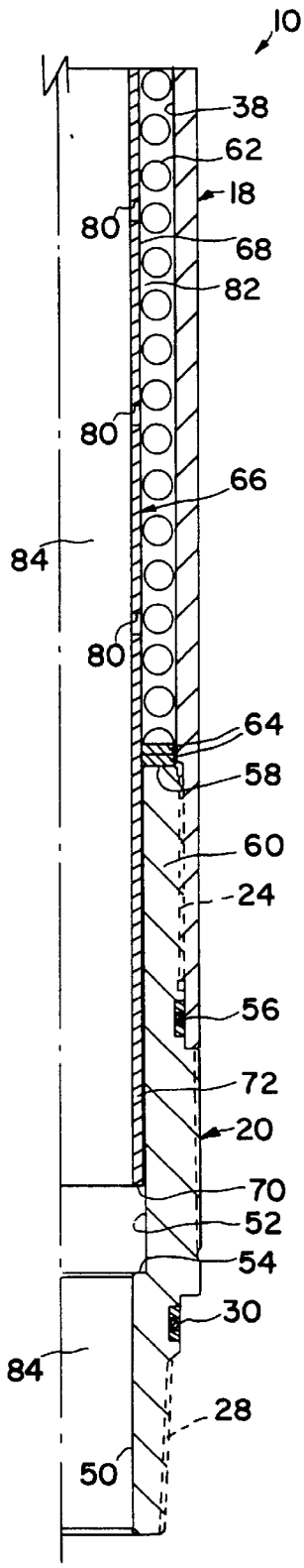

Referring additionally now to FIGS. 4A–4B, the valve 10 is representatively illustrated in a closed configuration thereof. The above-described differential pressure has been removed and the axially upwardly directed biasing force of the spring 62 has axially upwardly displaced the mandrel 86 relative to the upper case 16 and circulating case 18. Note that flow ports 96 are still axially downwardly disposed relative to the seal 44 and, thus, inner flow passage 84 is still isolated from fluid communication with the annular cavity 98.

When the above-described differential pressure is released, pin ends 120 are downwardly displaced relative to the ratchet 122, the mandrel 86 displacing axially upward relative to the upper case 16 as hereinabove described. Such downward displacement of the pin ends 120 will cause them to contact circumferentially inclined surfaces 128, thereby causing the ratchet 122 to axially rotate relative to the upper case 16. Note that surfaces 128 terminate at downwardly enclosed portions 130 of the J-slot 124, which limit further downward displacement of the pin ends 120 relative to the ratchet 122. Thus, pin ends 120 are utilized to limit axially upward displacement of the mandrel 86 relative to the upper case 16, but at this point little or no differential pressure is being applied to the mandrel, so the possibility of damage to the pin ends is greatly reduced.

With the J-slot 124 configured as representatively illustrated in FIGS. 2A–2B, two subsequent applications and releases of the above-described differential pressure may be performed with the downward displacement of the pin ends 120 relative to the ratchet 122 being limited by the enclosed portions 130. The valve 10 will correspondingly alternate between its closed configuration representatively illustrated in FIGS. 4A–4B, and its intermediate configuration representatively illustrated in FIGS. 3A–3B. It is to be understood that fewer or greater numbers of subsequent applications and releases of the above-described differential pressure may be performed to cause the valve 10 to alternate between its closed and intermediate configurations with suitable modifications of the J-slot 124 without departing from the principles of the present invention.

Thus, as representatively illustrated in FIG. 2B, with the pin ends 120 at positions C, two applications and two releases of the above-described differential pressure have been performed. With the pin ends 120 at positions D, three applications and two releases of the above-described differential pressure have been performed. It will be readily apparent to one of ordinary skill in the art that, starting with the pin ends 120 at positions A, if four applications and four releases of the above-described differential pressure are performed, the pin ends 120 will downwardly contact circumferentially inclined surfaces 132 of the J-slot 124, causing further axial rotation of the ratchet 122 relative to the upper case 16, and will return to positions A.

When the pin ends 120 return to positions A, the valve 10 is correspondingly returned to its open configuration as representatively illustrated in FIGS. 1A–1B. Flow ports 96 are again in fluid communication with the annular cavity 98, and circulating or reverse circulating via circulation ports 48 is again permitted. In this manner, the valve 10 may be reopened, and may be reclosed and reopened repeatedly by the application and release of the above-described differential pressure in the proper sequence as desired.

Thus has been described the valve 10 which, according to the representatively illustrated embodiment of FIGS. 1A–1B, 2A–2B, 3A–3B, and 4A–4B, is relatively uncomplicated in configuration and operation, which does not produce pressure differentials across its circulating ports 48, which does not have relatively small openings formed on external surfaces thereof which may be exposed to an annulus of an uncased wellbore, which does not require multiple ratchets 122, multiple lugs 116, or dogs formed on inner surfaces thereof, which does not require bearings or rotation of the ratchet 122 relative to the mandrel 86, which does not require circumferential alignment of the mandrel 86 relative to the upper case 16 or circulating case 18, which does not require the pin ends 120 to serve as limits to the full upward and downward displacement of the mandrel, which does not continually expose the ratchet 122 and spring 62 to annular fluid, which does not require a large number of seals, seal bores, etc., and which is economical to manufacture and maintain.

Figure 5A:
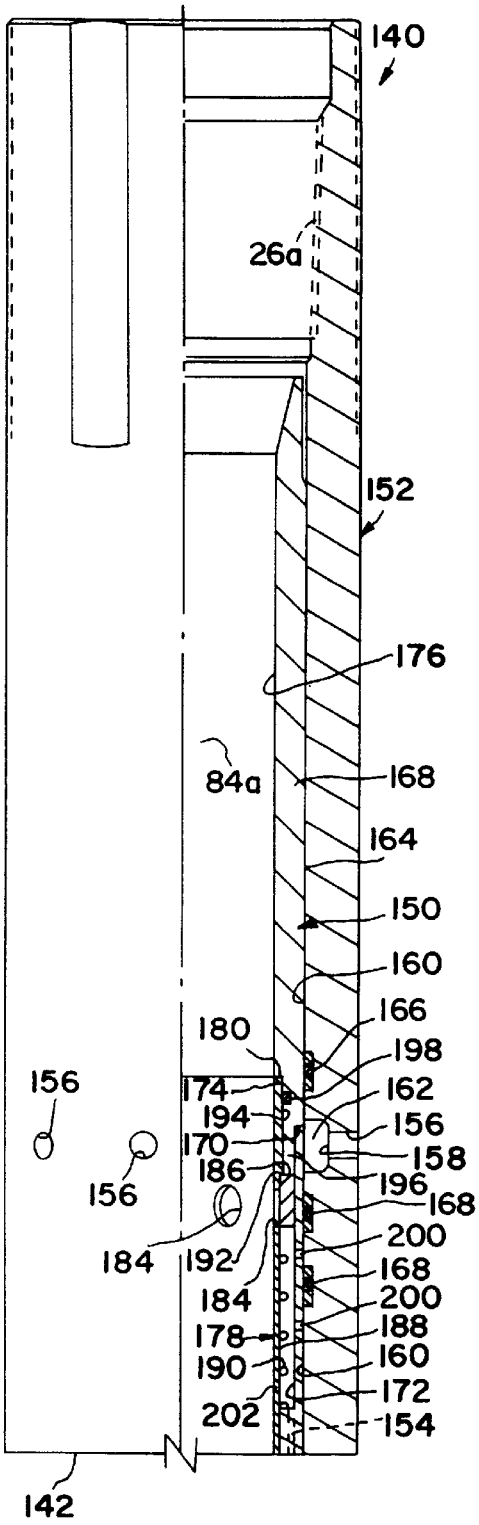
FIGS. 5A–5C are quarter-sectional views of successive axial portions of a second circulating valve embodying principles of the present invention, the valve being shown in an open configuration thereof.
Figure 5B:
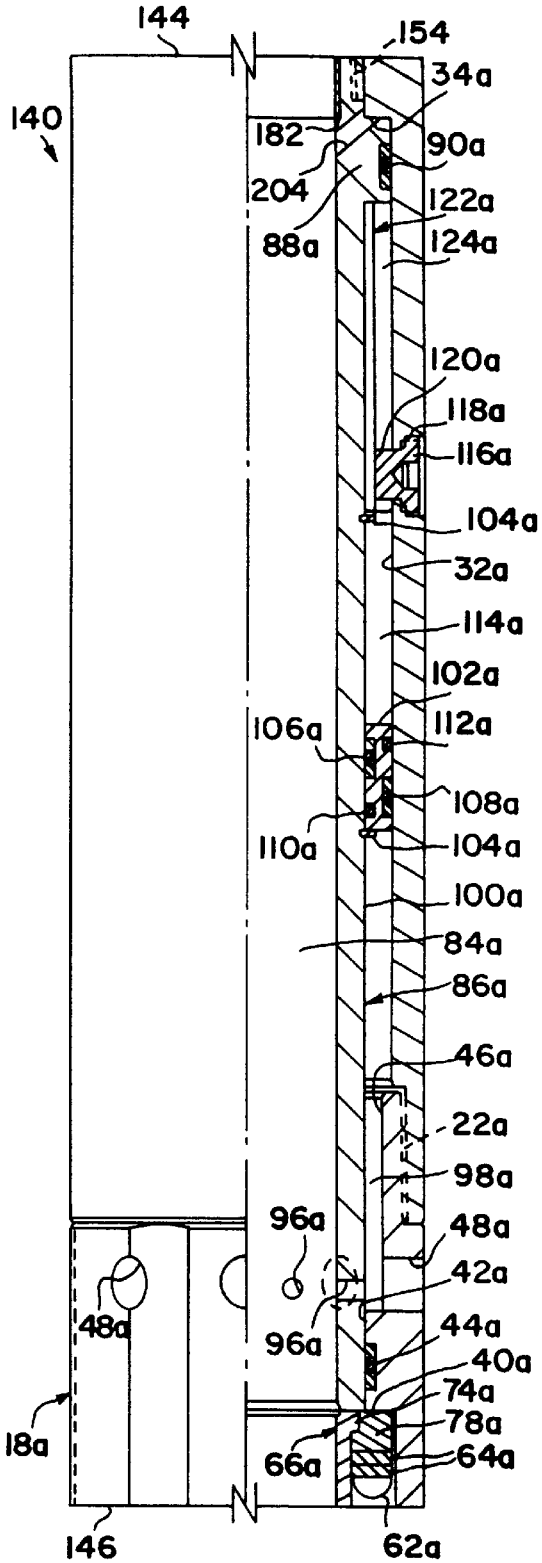
Figure 5C:
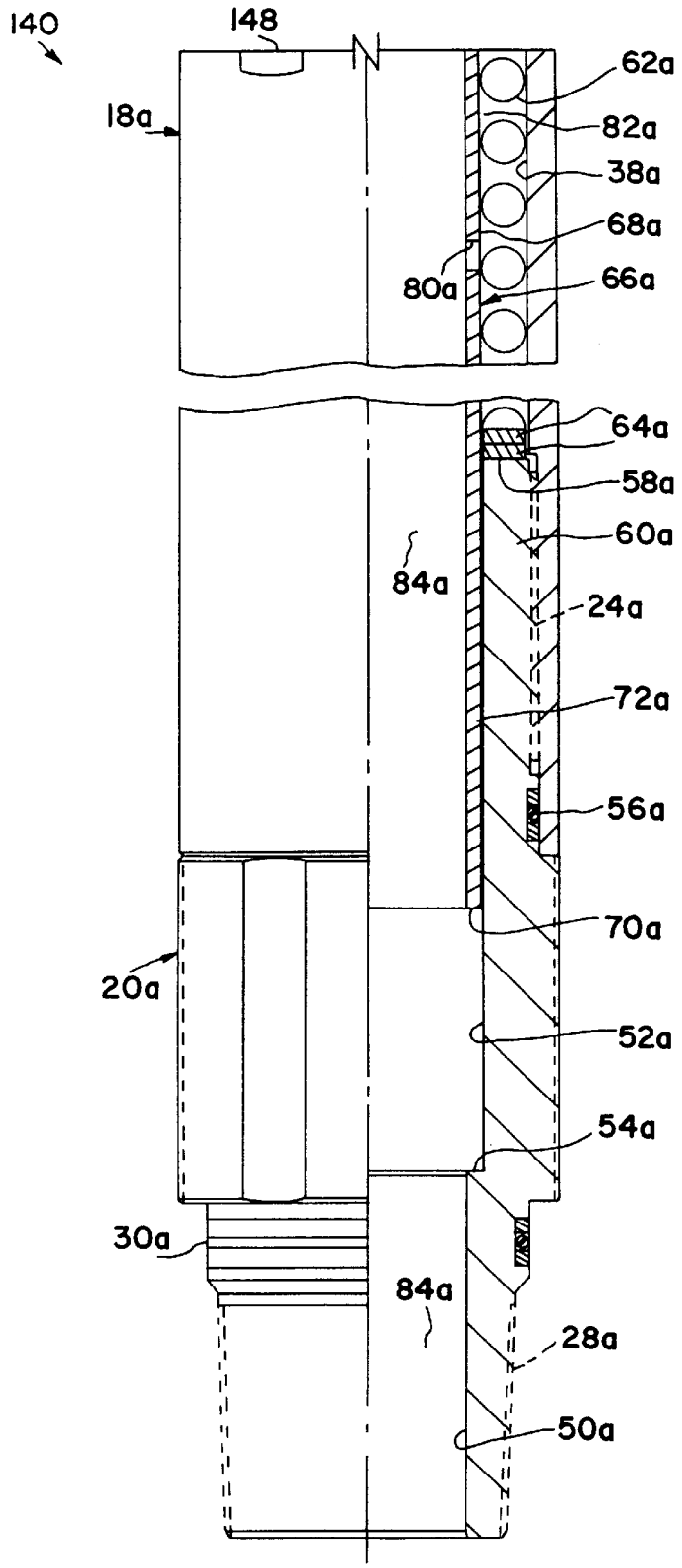

Referring additionally now to FIGS. 5A–5C, a valve 140 embodying principles of the present invention is representatively illustrated. The valve 140 shown in FIGS. 5A–5C is somewhat similar to valve 10 representatively illustrated in FIGS. 1A–1B, and includes additional features which enhance its special adaptation to operations in uncased wellbores. In FIGS. 5A–5C, elements of the valve 140 which are similar in structure and function to those elements previously described are designated with the same reference numerals as previously used, with an added suffix "a".

The valve 140 is shown in FIGS. 5A–5C in an open configuration in which the valve is run into a subterranean well. In the following detailed description of the valve 140, directional terms, such as "upper", "lower", "upward", "downward", etc., are used in relation to the illustrated valve 140 as it is depicted in the accompanying figures. It is to be understood that the valve 140 may be utilized in vertical, horizontal, inverted, or inclined orientations without deviating from the principles of the present invention. For convenience of illustration, FIGS. 5A–5C show the valve 140 in successive axial portions, but it is to be understood that the valve is a continuous assembly, lower end 142 of FIG. 5A being continuous with upper end 144 of FIG. 5B, and lower end 146 of FIG. 5B being continuous with upper end 148 of FIG. 5C.

Valve 140 includes a generally tubular and axially disposed mandrel extension 150 which is radially inwardly disposed relative to a generally tubular and axially disposed upper case 152. The mandrel extension 150 is threadedly attached to the mandrel **86*a* at a threaded connection 154, such that the mandrel extension is axially upwardly disposed relative to the mandrel. The upper case 152 is similar to the previously described upper case 16 and is threadedly attached to the circulating case 18*a* at threaded connection 22*a***.

Upper case 152 includes a series of circumferentially spaced apart reverse circulating ports 156 formed radially therethrough. The reverse circulating ports 156 radially intersect a radially enlarged diameter 158 internally formed on an axially extending inner bore 160 of the upper case 152. An axially extending annular cavity 162 is thus defined radially intermediate the diameter 158 and an outer side surface 164 of the mandrel extension 150. An internal circumferential seal 166 is disposed on the upper case 152 axially upward relative to the annular cavity 162, and two internal circumferential seals 168 are disposed on the upper case 152 axially downward relative to the annular cavity 162. Each of the seals 166 and 168 sealingly engage the outer side surface 164 of the mandrel extension 150.

The mandrel extension 150 has an elongated upper end portion 168. A circumferentially spaced apart series of ports 170, only one of which is visible in FIG. 5A, are formed radially through the mandrel extension 150 axially downward relative to the upper end portion 168. With the valve 140 in its open configuration as representatively illustrated in FIGS. 5A–5C, the ports 170 are axially aligned with the annular cavity 162 and in fluid communication therewith. Note that, in this open configuration of the valve 140, the ports 170 are also disposed axially intermediate the seal 166 and the seals 168. As will be more fully described hereinbelow, when the valve 140 is in its intermediate and closed configurations, ports 170 are axially downwardly displaced and ports 170 are no longer in fluid communication with the annular cavity 162, seals 168 being disposed axially intermediate the ports 170 and the annular cavity 162.

Mandrel extension 150 has a radially enlarged and axially extending internal bore 172 formed thereon radially inwardly overlapping the ports 170 and extending axially downward to the threaded connection 154. Axially upwardly disposed relative to the bore 172 is another axially extending internal bore 174 formed on the mandrel extension 150, the bore 174 being disposed axially intermediate the bore 172 and an internal bore 176 formed axially through the upper end portion 168.

A generally tubular and axially disposed inner sleeve 178 is received within the mandrel extension 150 and the mandrel 86*a* axially intermediate a radially extending internal shoulder 180 defined by bores 176 and 174, and an internal radially extending shoulder 182 formed on the upper end portion 88*a* of the mandrel 86*a*. A series of circumferentially spaced apart ports 184 are formed radially through the inner sleeve 178 and are axially downwardly disposed relative to the ports 170 on the mandrel extension 150.

An axially extending annular shuttle 186 is disposed radially intermediate the bore 172 and an outer side surface 188 of the inner sleeve 178. The shuttle 186 radially outwardly overlies the ports 184 as representatively illustrated in FIG. 5A, and is biased axially upward by a biasing member, such as axially extending compression spring 190, disposed radially intermediate the bore 172 and outer side surface 188. Axially upward displacement of the shuttle 186 is limited by a radially extending external shoulder 192 defined by outer side surface 188 and a radially enlarged outer side surface 194 formed on the inner sleeve 178.

An axially extending annular cavity 196 is defined radially intermediate bore 172 and outer side surface 194, and radially inwardly aligned with the ports 170. Annular cavity 196 is, thus, in fluid communication with ports 170, and is in fluid communication with annular cavity 162 with the valve 140 in its representatively illustrated open configuration. An internal circumferential seal 198 is disposed on the bore 174 of the mandrel extension 150 axially intermediate the shoulder 180 and the annular cavity 196, and sealingly engages the outer side surface 194 of the inner sleeve 178.

Mandrel extension 150 further has two axially spaced apart series of circumferentially spaced apart openings 200 radially formed therethrough, one of which is disposed axially intermediate the internal seals 168, and the other of which is disposed axially intermediate the lower one of the seals 168 and the threaded connection 154. Inner sleeve 178 further has an opening 202 formed radially therethrough axially intermediate the shuttle 186 and the mandrel 86*a*. Mandrel 86*a* has an axially inclined opening 204 formed radially through the upper end portion 88*a*, a radially outward end of the opening 204 being axially upwardly disposed relative to the seal 90*a*.

Shuttle 186 restricts fluid communication between the annular cavity 196 and the ports 184. When the fluid pressure existing in the inner flow passage 84*a* is greater than the fluid pressure external to the valve 140, a differential pressure is created across the shuttle, which differential pressure produces an axially upwardly directed biasing force on the shuttle. Although shuttle 186 as representatively illustrated does not have seals sealingly engaged therewith, in a preferred embodiment the shuttle is a very close sliding fit within the bore 172 and on the inner sleeve 178, such that only a negligible quantity of fluid may bypass the shuttle when the differential pressure axially upwardly biases the shuttle. It is to be understood that means may be provided for positively sealingly engaging the shuttle 186 with either or both of the bore 172 and the inner sleeve 178 without departing from the principles of the present invention.

Thus, when it is desired to circulate fluid through the valve 140, the fluid flowing from the inner flow passage 84*a* radially outwardly to the exterior of the valve 140, substantially all of such fluid flow will be through flow ports 96*a*. Valve 140 may, therefore, be cycled to intermediate and closed configurations as previously described hereinabove for the valve 10, by alternately applying and releasing a differential pressure. Although valve 140 is only representatively illustrated herein in its open configuration, it is to be understood that the valve 140 has such intermediate and closed configurations corresponding to the configurations of the valve 10 previously described.

In its representatively illustrated open configuration of FIGS. 5A–5C, when it is desired to reverse circulate fluid through the valve 140, fluid flowing from the exterior of the valve radially inwardly to the inner flow passage 84*a*, such fluid may flow radially inwardly through circulating ports 48*a* and flow ports 96*a*, and, additionally, such fluid may flow radially inwardly through ports 156, annular cavity 162, ports 170, annular cavity 196, and ports 184 in a manner that will now be described. When the pressure existing in the fluid exterior to the valve 140 exceeds the pressure of the fluid in the inner flow passage 84*a*, shuttle 186 is axially downwardly biased by a differential pressure thereacross. If an axially downwardly directed force produced by such differential pressure across the shuttle 186 exceeds an axially upwardly directed biasing force applied to the shuttle by the spring 190, the shuttle will be axially downwardly displaced relative to the ports 184 and will completely, or at least partially, axially traverse the ports 184, thereby providing essentially unrestricted fluid communication between the annular cavity 196 and the ports 184.

Thus, valve 140 is particularly well adapted for use in uncased wellbores where essentially unrestricted reverse circulating of fluid is very desirable, so that large pressures are not applied to fluid in the annulus. As pointed out hereinabove, such large pressures on fluid in the annulus of an uncased wellbore may cause damage to formations intersected by the wellbore, and may have other harmful effects on the well and operations therein. However, there are also situations in which it is desirable for a circulating valve, such as valve 140, to not permit circulating or reverse circulating flow therethrough. Valve 140 has additional features which permit it, in its closed configuration, to prevent both circulating and reverse circulating flow therethrough.

In its closed and intermediate configurations, corresponding to the similar closed and intermediate configurations of the valve 10 representatively illustrated in FIGS. 4A–4B and 3A–3B, respectively, the mandrel 86*a* of the valve 140 is axially downwardly displaced and flow ports 96*a* are axially downwardly disposed relative to the seal 44*a*, preventing fluid communication between the flow ports and the annular cavity 98*a*. In addition, mandrel 86*a* carries the mandrel extension 150, inner sleeve 178, shuttle 186, and spring 190, all of which are directly or indirectly interconnected to the mandrel, axially downward therewith. Thus, ports 170 are axially downwardly displaced relative to the annular cavity 162. In the closed and intermediate configurations of the valve 140, ports 170 have axially traversed the seals 168 and are axially downwardly disposed relative thereto, thereby preventing fluid communication between the ports 170 and the annular cavity 162.

Valve 140, therefore, in its open configuration permits relatively unrestricted reverse circulation flow therethrough, but in its intermediate and closed configurations prevents both circulating and reverse circulating flow therethrough.

Referring additionally now to FIG. 6, a method of servicing a well 208 embodying principles of the present invention is representatively illustrated. A subterranean well 212 is shown which has a generally vertical uncased wellbore 214. It is to be understood that the present invention may be utilized in wellbores which are otherwise oriented, such as vertically inclined or horizontal, and in cased wellbores without departing from the principles of the present invention. In the following detailed description of the embodiment of the present invention representatively illustrated in FIG. 6, directional terms, such as "upper", "lower", "upward", "downward", etc., are used in relation to the method 208 as representatively illustrated.

FIG. 6 shows a circulating valve 210, which may be either the valve 10 or the valve 140, installed axially intermediate a conventional landing nipple 216 and an embodiment of the Early Evaluation System (EES) 218 of Halliburton Energy Services. The EES 218 is described in the U.S. patent application referred to hereinabove, and the reader's attention is directed thereto for a thorough description of its structure, function, and operation, including a method of using the EES in servicing a well. It is to be understood that the representatively illustrated disposition of the valve 210 in relation to the nipple 216 and the EES 218 is not meant to preclude other dispositions, arrangements, installations, etc. of the valve 210 within the wellbore 214, nor is it meant to suggest that the valve 210 must be used with the nipple 216 or EES 218, or either of them, instead, it is to be understood that the valve 210 may be otherwise utilized without departing from the principles of the present invention.

In one manner of using the EES 218, packers 222 radially outwardly and sealingly engage the wellbore 214 and fluid is pumped from a formation 220 axially upwardly through the EES 218 to an annular chamber 224 formed on the EES. The formation fluid may be further pumped axially upwardly through axially extending openings 226 to an interior flow passage portion 228. Flow passage portion 228 is in fluid communication with an axial flow passage 230 of the valve 210, which axial flow passage 230 may correspond to flow passage 84 or 84*a* of valve 10 or 140, respectively.

In a like manner, the formation fluid may be pumped by the EES 218 further axially upward through the nipple 216, tubing 232, other tools and equipment (not shown), etc. It is, however, impractical, or at least very time-consuming, in wells having substantial axial lengths, to utilize the EES 218 to pump formation fluid to the earth's surface for inspection, testing, evaluation, etc. thereof. For this reason, the EES 218 provides means for retrieving samples and measurement data of the formation fluid via wireline, slickline, coiled tubing, etc. Where, however, it is impossible, impractical, or uneconomical to so retrieve samples or data from the EES 218, the valve 210 provides an alternate or additional means of retrieving the formation fluid.

With the formation fluid pumped axially upwardly into the flow passage 230 as described hereinabove, any portion of the formation fluid which is above ports 234 may be reverse circulated to the earth's surface for inspection, testing, evaluation, etc. thereof at the earth's surface by pumping fluid, such as weighted brine water, etc., from the earth's surface downwardly through the annulus 236 to the valve 210, radially inwardly through the ports 234, which may correspond to ports 48 or 48*a* of valve 10 or 140, respectively, the valve 210 being in its open configuration, and thence axially upwardly through the flow passage 230 and eventually to the earth's surface via the tubing 232, thereby axially upwardly displacing the formation fluid to the earth's surface.

Where conditions are such that reverse circulation of the formation fluid to the earth's surface by pumping fluid radially inwardly through ports 234 as hereinabove described would be uneconomical, too time-consuming, or impractical, such as when the formation fluid would have to be displaced an inordinately long axial distance, or when a large fluid pressure would have to be applied to the annulus 236 to achieve an acceptable reverse circulating flow rate, valve 140 may be utilized for valve 210, in which case additional ports 238, corresponding to ports 156 of valve 140, are provided for additional, relatively unrestricted reverse circulating flow therethrough. With the valve 210 in its open configuration, ports 234 and ports 238 provide sufficient reverse circulating flow rates therethrough to quickly axially upwardly displace the formation fluid via the tubing 232.

When the formation fluid is reverse circulated out of the well 212 as hereinabove described, it is inevitable that there will be some mixing of the formation fluid with the fluid utilized to displace the formation fluid. Where such fluid mixing is unacceptable, one or more instruments, fluid samplers, etc., known to those skilled in the art as bomb-drop gauges, samplers, etc., such as representatively illustrated sampler 240, may be dropped, lowered, circulated, etc. to a position for convenient access to the formation fluid, such as within the landing nipple 216. Although the sampler 240 is representatively illustrated as being axially spaced apart from the EES 218, it is to be understood that they may be coupled by, for example, a stinger (not shown) extending between the sampler and the EES, without departing from the principles of the present invention.

After the formation fluid is pumped axially upward to the landing nipple 216, the sampler 240 may acquire a sample of the formation fluid, or, for example, if a temperature and/or pressure sensor is utilized, it may record the temperature and/or pressure of the formation fluid. Thereafter, when it is desired to retrieve the sampler 240 to the earth's surface, the sampler may be axially upwardly displaced to the earth's surface via the tubing 232 by pumping fluid, such as weighted brine water, etc., from the earth's surface downwardly through the annulus 236 to the valve 210, radially inwardly through the ports 234, the valve 210 being in its open configuration, and thence axially upwardly through the flow passage 230 and eventually to the earth's surface via the tubing 232, thereby axially upwardly displacing the sampler 240 to the earth's surface.

Where conditions are such that reverse circulation of the sampler 240 to the earth's surface by pumping fluid radially inwardly through ports 234 as hereinabove described would be uneconomical, too time-consuming, or impractical, such as when the sampler 240 would have to be displaced an inordinately long axial distance, or when a large fluid pressure would have to be applied to the annulus 236 to achieve an acceptable reverse circulating flow rate, valve 140 may be utilized for valve 210, in which case additional ports 238, corresponding to ports 156 of valve 140, are provided for additional, relatively unrestricted reverse circulating flow therethrough. With the valve 210 in its open configuration, ports 234 and ports 238 provide sufficient reverse circulating flow rates therethrough to quickly axially upwardly displace the sampler 240 via the tubing 232.

Thus has been described a method of servicing a well 208, which permits formation fluid or instruments and/or equipment 240 to be quickly and conveniently displaced to the earth's surface without requiring the utilization of wireline, slickline, coiled tubing, etc. for retrieval thereof. Additionally, by utilizing valve 140, high circulating flow rates may be achieved to reduce the time required to retrieve the formation fluid or instruments and/or equipment 240. Furthermore, such utilization of valve 140 reduces the pressure which must be applied to the annulus 236 to achieve an acceptable reverse circulating flow rate, which reduced annulus pressure is particularly desirable in uncased wellbores, such as wellbore 214.

The foregoing detailed description is to be clearly understood as being given by way of illustration and example only, the spirit and scope of the present invention being limited solely by the appended claims.

What is claimed is:

1. For use within a subterranean well having an annulus and a tubular conduit longitudinally disposed therein, each of the annulus and tubular conduit having a fluid contained therein, a circulating valve comprising:

a generally tubular outer housing having an upper attachment portion capable of sealingly engaging the tubular conduit, a first axially extending internal bore, a second axially extending bore, the second axially extending bore being radially reduced relative to the first axially extending bore, and a first radially extending opening formed through the housing and intersecting the first axially extending bore;

a generally tubular mandrel axially received in the housing and having first and second outer side surfaces, the first outer side surface being radially enlarged relative to the second outer side surface and being in sealing and sliding engagement with the first axially extending bore, the second outer side surface being in sealing and sliding engagement with the second axially extending bore, a second radially extending opening formed through the mandrel and intersecting the second outer side surface, and the mandrel further having a first position relative to the outer housing in which the second opening is in fluid communication with the first opening and a second position in which the second opening is disposed within the second axially extending bore and isolated from fluid communication with the first opening; and a member radially inwardly disposed relative to a third opening formed radially through the housing, the member being capable of permitting substantially unrestricted flow of the annulus fluid radially inwardly through the third opening, and the member being capable of restricting flow of the tubing fluid radially outwardly through the third opening.

2. A valve operatively interconnectable in a tubular string within a subterranean well, the valve comprising:

an outer housing having first and second ports configured for permitting fluid flow through a sidewall of the housing; and a mandrel movably and sealingly disposed at least partially within the housing, the mandrel being displaceable between first and second positions relative to the housing, fluid flow being permitted inwardly and outwardly through the first port, and fluid flow being permitted substantially unrestricted inwardly through the second port and substantially prevented outwardly through the second port, when the mandrel is in the first position, and fluid flow being prevented through the first and second ports when the mandrel is in the second position.

3. The valve according to claim 2, wherein relative displacement between the mandrel and housing is controlled by a ratcheting device.

4. The valve according to claim 2, wherein the mandrel displaces from the first position to the second position in response to a predetermined number of fluid pressure applications to an internal flow passage of the mandrel.

5. A valve operatively interconnectable in a tubular string within a subterranean well, the valve comprising:

a generally tubular housing having a sidewall and a port formed through the sidewall; and a mandrel displaceable between first and second positions relative to the housing, fluid flow being permitted inwardly through the housing sidewall at a rate greater than fluid flow permitted outwardly through the housing sidewall, and fluid flow outwardly through the housing sidewall being permitted, when the mandrel is in the first position, and fluid flow through the housing sidewall being prevented when the mandrel is in the second position.

6. The valve according to claim 5, wherein relative displacement between the mandrel and housing is controlled by a ratcheting device.

7. The valve according to claim 5, wherein the mandrel displaces from the first position to the second position in response to a predetermined number of fluid pressure applications to an internal flow passage of the mandrel.

8. A valve operatively interconnectable in a tubular string within a subterranean well, the valve comprising:

a generally tubular mandrel having a flow passage formed generally axially therethrough, the mandrel being sealingly received within a generally tubular housing, the housing including at least one circulation port permitting fluid communication through a sidewall of the housing, the mandrel displacing from a first position relative to the housing in which the mandrel permits fluid flow through the circulation port to a second position relative to the housing in which the mandrel prevents fluid flow through the circulation port in response to a first predetermined number of applications of a first predetermined fluid pressure to the flow passage, the mandrel displacing from the second position to the first position in response to a second predetermined number of applications of a second predetermined fluid pressure to the flow passage, and the housing further including at least one reverse circulation port for permitting fluid communication through the housing sidewall, substantially unrestricted inwardly directed fluid flow being permitted and outwardly directed fluid flow being substantially prevented through the reverse circulation port when the mandrel is in the first position.

9. The valve according to claim 8, wherein fluid flow is prevented through the reverse circulation port when the mandrel is in the second position.

10. The valve according to claim 8, wherein the mandrel displaces relative to the housing against a biasing force exerted by a biasing device.

11. The valve according to claim 8, wherein the first and second predetermined numbers of applications are determined by a ratcheting device interconnected to the mandrel and housing.

12. A valve operatively interconnectable in a tubular string within a subterranean well, the valve comprising:

a generally tubular mandrel having a flow passage formed generally axially therethrough, the mandrel being sealingly received within a generally tubular housing, the housing including at least one circulation port permitting fluid flow through a sidewall of the housing, the mandrel displacing from a first position relative to the housing in which the mandrel permits fluid flow through the circulation port to a second position relative to the housing in which the mandrel prevents fluid flow through the circulation port in response to a first predetermined number of applications of fluid flow from the flow passage and through the circulation port, the mandrel displacing from the second position to the first position in response to a second predetermined number of applications of a predetermined fluid pressure to the flow passage, and the housing further including at least one reverse circulation port for permitting fluid flow through the housing sidewall, fluid flow being prevented through the reverse circulation port when the mandrel is in the second position, and inwardly directed fluid flow being permitted through the reverse circulation port at a rate greater than that permitted through the circulation port when the mandrel is in the first position.

13. The valve according to claim 12, wherein the mandrel displaces relative to the housing against a biasing force exerted by a biasing device.

14. The valve according to claim 12, wherein the first and second predetermined numbers of applications are determined by a ratcheting device interconnected to the mandrel and housing.

15. A method of servicing a subterranean well, the method comprising the steps of:

interconnecting a valve in a tubular string, the valve including a mandrel and a housing, and the mandrel being displaceable between first and second positions relative to the housing; and applying a first predetermined number of fluid pressure applications to the valve while the mandrel is in the first position and fluid flow outwardly through the valve is permitted at a rate less than at rate at which fluid flow is permitted inwardly through the valve, and fluid flow outwardly through the valve being permitted while the mandrel is in the first position, the first fluid pressure applications causing the mandrel to displace to the second position.

16. The method according to claim 15, further comprising the step of applying a second predetermined number of fluid pressure applications to the valve while the mandrel is in the second position and fluid flow inwardly and outwardly through the valve is prevented, the second fluid pressure applications causing the mandrel to displace to the first position.

* * * * *